US005112241A

United States Patent [19]

Chesnut et al.

[11] Patent Number: 5,112,241

[45] Date of Patent: May 12, 1992

[54] CONNECTOR SEAL ARRANGEMENT

[75] Inventors: Paul B. Chesnut, Owensboro, Ky.; Michael D. Cooper; Jerry A. Neas, both of Greeneville, Tenn.

[73] Assignee: Incor Systems, Inc., Brentwood, Tenn.

[21] Appl. No.: 619,496

[22] Filed: Nov. 29, 1990

[51] Int. Cl.[5] ..... H01R 13/52

[52] U.S. Cl. ..... 439/273; 439/274; 439/559

[58] Field of Search ..... 439/271-283, 439/559, 544, 586-588, 597, 599

[56] References Cited

U.S. PATENT DOCUMENTS

| | | | |
|---|---|---|---|
| 2,322,491 | 6/1983 | Williams | 439/587 |
| 3,167,374 | 1/1965 | Healy | 439/588 |
| 3,941,444 | 3/1976 | Bruni et al. | 439/587 |
| 4,063,793 | 12/1977 | Judd | 439/588 |
| 4,274,692 | 6/1981 | Hoffman et al. | 439/588 |
| 3,7553,212 | 8/1973 | Yamada et al. | 439/588 |

*Primary Examiner*—David Pirlot
*Attorney, Agent, or Firm*—Warren D. Flackbert

[57] ABSTRACT

A connector seal arrangement having particular adaptability for use within the insulation space between the inner wall and the cabinet wall of a household refrigerator and having a portion extending into the refrigerated space. The rear seal snaps into a watertight relationship with a recess defined at the end of the connector, whereas the front seal is disposed on an upstanding plate or flange extending from the mid-region of the connector. The inner seal is, typically, overmolded on the aforesaid plate and includes a skirt or boot in engagement with the inner surface of the inner wall of the refrigerator. Introduction of insulation presents a sealing relationship between the skirt or boot and the aforesaid inside wall surface. In order to achieve more versatility, the rear seal may include an opening presenting a fracturable membrane for the selective introduction of an electrical connector(s) depending upon total needs. In another invention form, the inner seal may be hand-fitted to a use position on the upstanding flange.

3 Claims, 2 Drawing Sheets

CONNECTOR SEAL ARRANGEMENT

BACKGROUND OF THE INVENTION

As is known, a continual design target in the development of refrigeration mechanisms, such as household refrigerators, with optimum efficiency, includes, wherever possible, minimal overall dimensioning commensurate with maximum storage volume.

One approach to the latter objective is achieved through the minimization of insulation thickness, as between the inner liner and the outer cabinet; however, such space serves other necessary physical purposes requiring recognition, such as, for example, containing the electrical wiring harness necessary for refrigeration control. As an example, a connector is typically employed for receiving an electrical plug employed forming part of an automatic ice maker mechanism.

More precisely, the aforesaid typical connector includes a front portion, extending into the storage space defined by the inner liner, and a rear portion extending into the space which ultimately will receive foam type insulation (oftentimes in tight quarters).

The connector per se may assume various and/or different configurations, depending upon end usage, and includes, by way of example, side-by-side cavities into which electrical wires/contacts are inserted for ready electrical connection with the aforesaid wiring harness disposed within the insulation receiving space between the inner liner and the outer cabinet. The connector, which is not the instant invention, must, however, be arranged to restrain foam insulation flow into the refrigerated storage space and, as well, prevent insulation flow into the connector itself.

BRIEF DESCRIPTION OF THE INVENTION

The invention achieves the preceding by providing a recess inwardly arranged around the rear edge thereof adapted to receive a detachable rear seal presenting a series of fracturable membranes each covering a passageway provided to selectively receive an electrical wire segment/terminal.

The forward end of the connector, i.e. that portion which extends from the insulation space includes a peripheral flange or plate which, together with inclined fingers, accommodates the thickness occasioned in the usage of a metal refrigerator liner. A foam type gasket may be utilized for this form of sealing.

In the alternative, the aforesaid peripheral flange or plate on the connector may serve to receive a gasket or seal by virtue of a bifurcated portion on the latter, typically overmolded onto the connector. A skirt or flexible boot extends toward the front of the connector and into loose engagement with the rear surface of the wall against which foam will ultimately be introduced and bear.

As the latter occurs, the skirt is forced against the wall and assumes an installed shape, i.e. one which positively surrounds the connector and prevents any foam passage through the wall opening, even that present for the needed tolerance for connector placement.

DESCRIPTION OF THE FIGURES

In any event, a better understanding of the present invention will become more apparent from the following description, taken in conjunction with the accompanying drawings, wherein.

Figure 1:
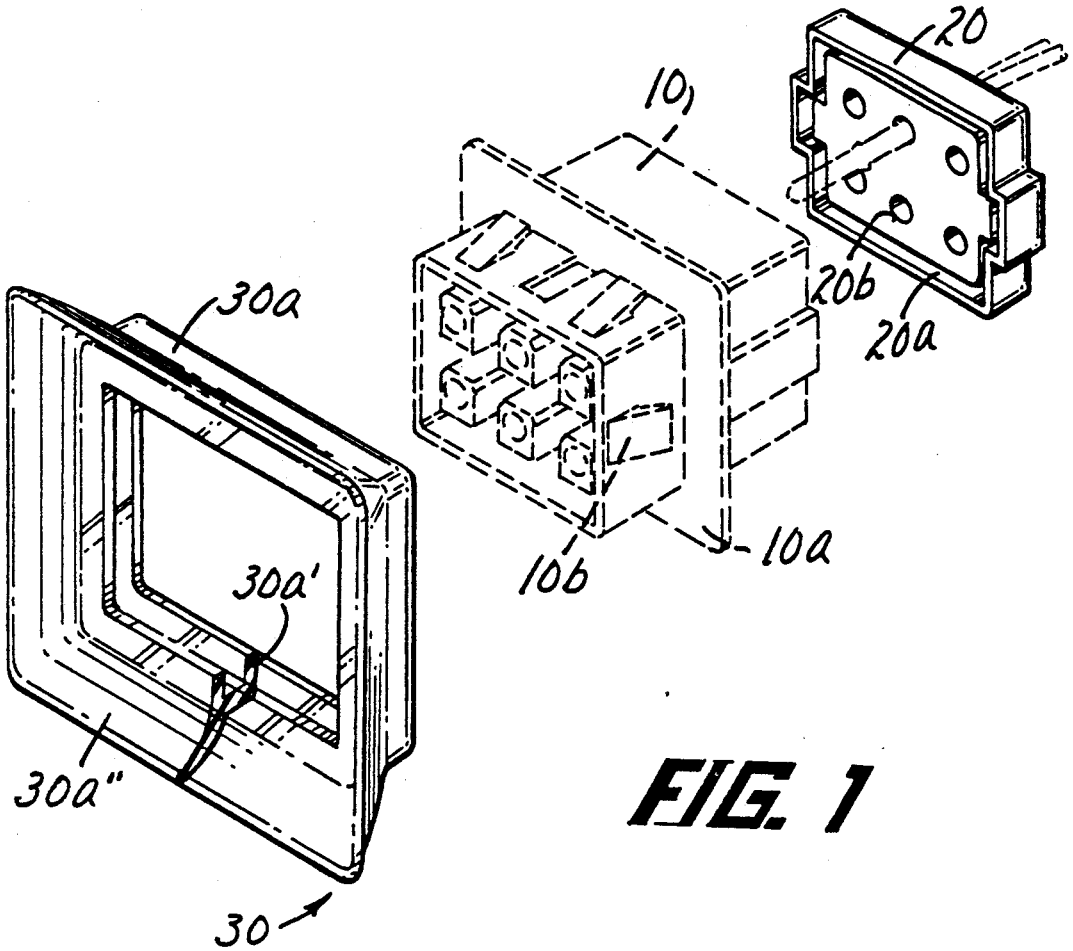
FIG. 1 is an exploded view showing a front and a rear seal in accordance with the teachings of the invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

DESCRIPTION OF THE PREFERRED EMBODIMENT

Figure 2:
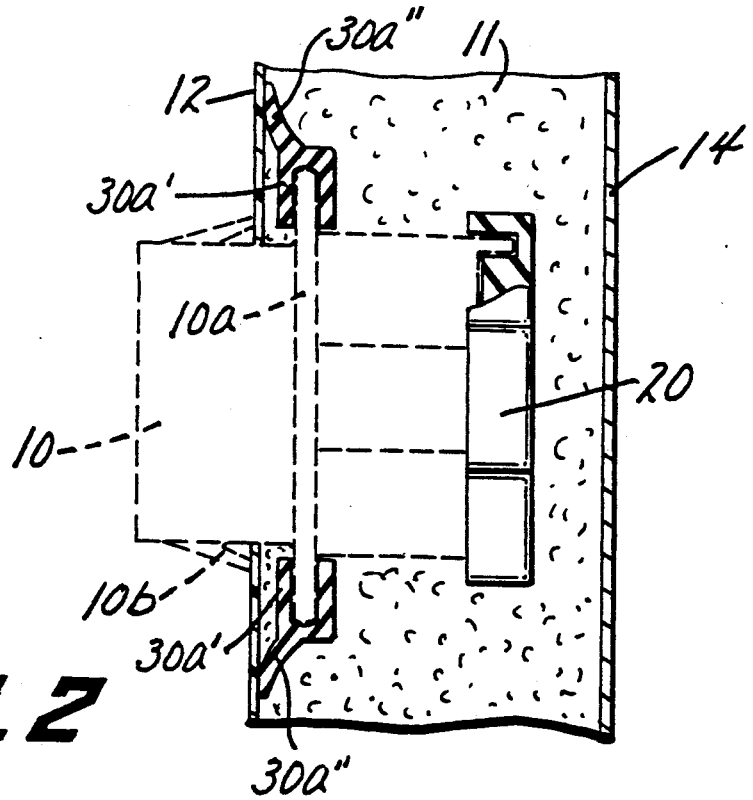
FIG. 2 is a view in elevation, partly in vertical section, detailing both seals as presented in an installed condition.
Figure 4:
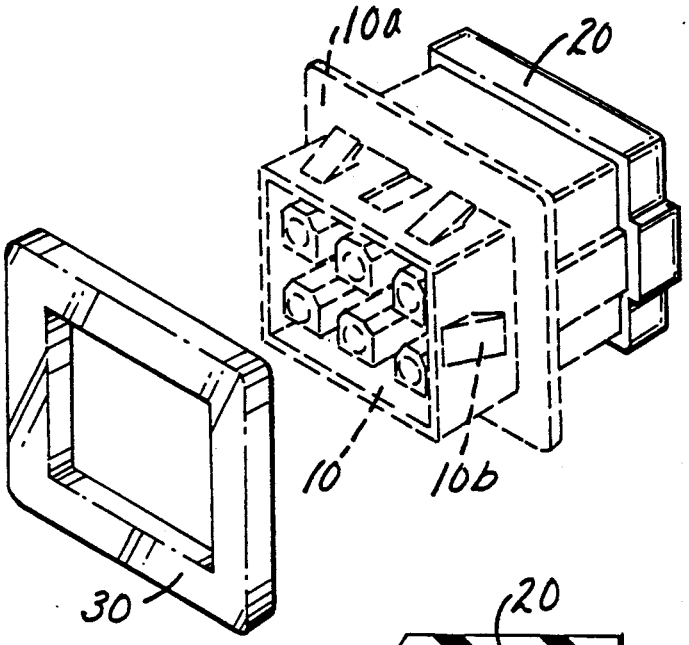
FIG. 4 is another view in perspective detailing another form of front seal presented by the invention.

Referring now to FIGS. 1, 2 and 4, the seal arrangement provided by the invention is developed for particular use in association with a connector 10 forming part of the wiring system for refrigeration equipment, such as a common household refrigerator.

The aforesaid connector 10, which is not the subject of the invention herein per se, is typically disposed in insulation 11 between the inner wall 12 and the outer cabinet 14, i.e. where a rear portion thereof extends within the insulation space provided between the inner wall 12 and the outer cabinet 14, and the front portion extends beyond the inner wall 12. The connector 10 may serve a variety of purposes including, for example, receiving the electrical plug required in the installation of an automatic ice maker.

In any event, importance lies in the fact of preventing insulation flow, either through the tolerance space in the wall 12 surrounding the connector 10 or through the connector 10 itself, where either of which would result in a faulty, if not unworkable, arrangement.

Looking first at the rear portion of the connector 10, such typically includes an edge presenting a recess which permits the receipt of a seal or closure 20 with a double or forked edge **20*a* thereon. In other words, the outer peripheral edge of the connector 10 is readily received into the rear seal or closure 20 (see FIG. 2**).

Seal or closure 20 includes openings **20*b* (see FIGS. 1, 5 and 6) for the introduction of electrical wire segment/terminals of the electrical system. The closure 20 may also include one or more drilled openings 20*b*', staggered and terminating at a fracturable membrane 20*b*''** and also serving to receive, as required, an electrical line/terminal. In other words, the latter relationship affords more versatility as to the number of openings for electrical service.

As to the front seal, the typical connector 10 includes a peripheral flange or plate **10*a* in the general mid-region thereof, where the body of the connector 10 includes flexible fingers 10*b* which serve to position the connector 10 within the defined opening in the adjacent wall 12. Usually, a flat seal or gasket 30, having foam properties, is disposed on the connector 10 between the fingers 10***b* and the wall 12 (see FIG. 4), serving to firm the assembly and, at the same time, prevent insulation flow during production.

In another version, and considering the fact that the thickness of the wall 12, particularly when formed from plastic, may considerably vary, is an overmolded seal 30*a* presenting a bifurcated portion 30*a'* which is received on the edge of the aforesaid plate or flange 10*a* on the connector 10, where a skirt or boot portion 30*a''* thereof may initially engage the inside surface of wall 12 (it is subsequently moved into a positive sealing position when insulation is introduced into the space between the inner wall 12 and the outer cabinet 14). Thus, any thickness or irregularity of the inner wall 12 is positively accommodated by the form of seal 30*b* depicted in FIGS. 1 and 2.

Figure 3:
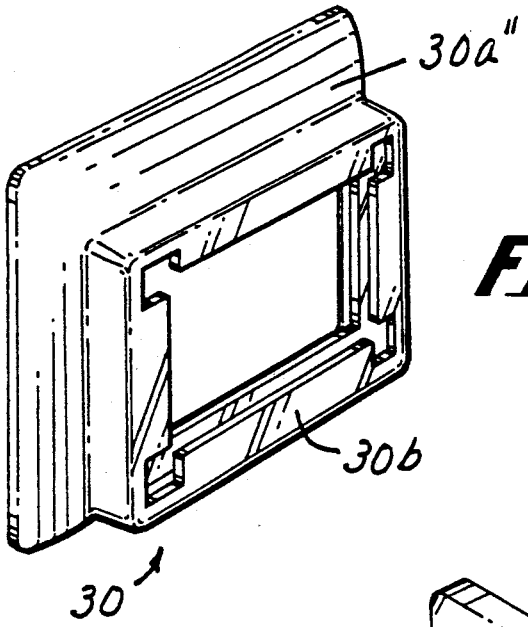
FIG. 3 is a perspective view of a front seal proposed for optional manual assembly in contrast to an overmolding technique.

FIG. 3 discloses a front seal 30 which is not secured by overmolding, but, instead, includes a portion 30*b* arranged on flange 10*a* by a hand-fitting/cutting operation.

Figure 5:
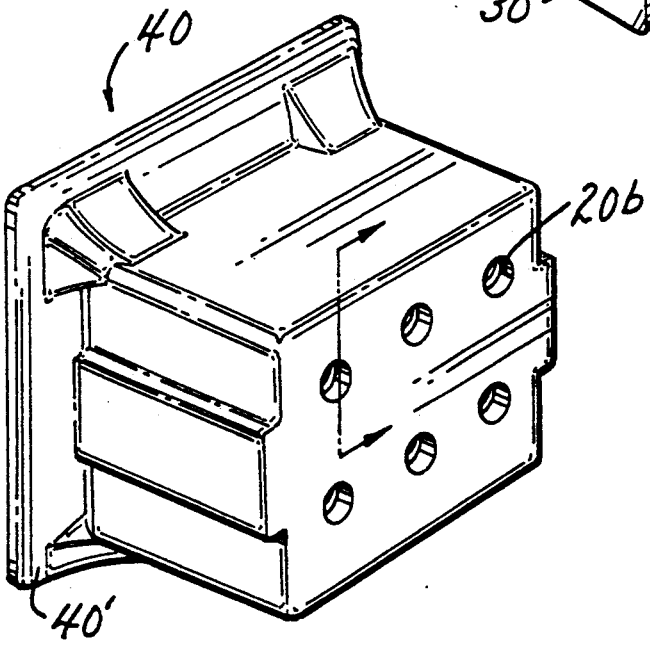
FIG. 5 is a perspective showing the instant seal arrangement as a single part; and, FIG. 6 is a view in cross section, taken at line 6—6 on FIG. 5 and looking in the direction of the arrows, detailing another feature of the invention.
Figure 6:
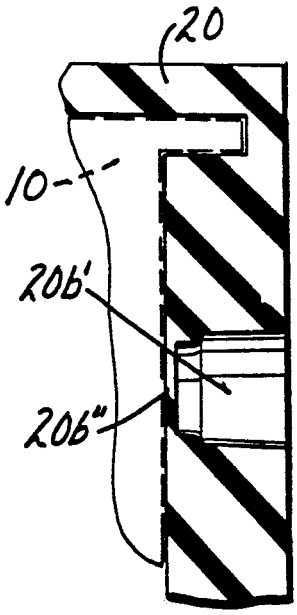

Additionally, and as a further point of refinement of the invention, both the rear 20 and front seals 30 may be combined and presented in an integral form 40, i.e., and looking at FIG. 5, the rear surface of the seal 20 overlies the rear of the connector 10, extending forwardly into confinement with the peripheral edge of the flange 10*a*, and terminating in the skirt and/or boot 40' which positively engages the inner surface of the inner wall 12 upon insulation flow.

Thus, a variety of seal/gasket arrangements are provided herein, including the aforesaid rear closure 20, with or without a provision of multiple electrical segment openings; a single foam front seal 30*a*, particularly adaptable in the instance of a metal inner liner; a front seal 30*b* arranged around the peripheral edge of a flange or plate on the connector (which includes a skirt or boot 30*b''* selectively engagable, in a sealing relationship, with the insulation 11); and, an integral front and rear seal 40, easily adapted to a use condition under certain circumstances, which serves the functions of both rear and front sealing.

The connector seal arrangement described hereabove is susceptible to various changes within the spirit of the invention, including, by way of example, in proportioning; the type of material from which the seals are fabricated; the precise manner of affixing the front seal to the connector; the installation use site; and, the like. Thus, the preceding should be considered illustrative and not as limiting the scope of the following claims:

We claim:

1. A seal for an electrical connector having a peripheral flange at the mid-region thereof comprising a closure overlying an end of said electrical connector in a moisture blocking relationship, where said electrical connector extends through an opening in an inner wall of a refrigerator, where another part of said electrical connector extends into space between said inner wall and an outer wall of said refrigerator, where said seal includes a bifurcated inner portion adapted to be received on said flange on said electrical connector, where a skirt extending from said inner portion selectively engages the inner surface of said inner wall around said opening through which said electrical connector passes, and where sealing is maintained by means of insulation flow in said space between said outer wall and said inner wall bearing against the skirt.

2. The seal of claim 1 where said skirt is flexible.

3. A seal for an electrical connector having a peripheral flange at the mid-region thereof comprising a closure overlying an end of said electrical connector in a moisture blocking relationship, where said electrical connector extends through an opening in an inner wall of a refrigerator, where another part of said electrical connector extends into space between said inner wall and an outer wall of said refrigerator, where said seal includes a portion facing the inner surface of said inner wall adapted to be received proximate said flange on said electrical connector in a seal locating relationship, where a skirt extending from said portion selectively engages said inner surface of said inner wall around said opening through which said electrical connector passes, and where sealing is maintained by means of insulation flow in said space between said outer wall and said inner wall bearing against said skirt.

* * * * *